US011298740B2

(12) United States Patent
Wilkosz et al.

(10) Patent No.: US 11,298,740 B2
(45) Date of Patent: Apr. 12, 2022

(54) VIBRATION ASSISTED FREE FORM FABRICATION

(71) Applicant: Ford Global Technologies, LLC, Dearborn, MI (US)

(72) Inventors: Daniel E. Wilkosz, Saline, MI (US); Vijitha Seraka Kiridena, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 474 days.

(21) Appl. No.: 16/224,865

(22) Filed: Dec. 19, 2018

(65) Prior Publication Data

US 2019/0118239 A1 Apr. 25, 2019

Related U.S. Application Data

(62) Division of application No. 14/810,609, filed on Jul. 28, 2015, now Pat. No. 10,195,655.

(51) Int. Cl.

| | |
|---|---|
| ***B21D 31/00*** | (2006.01) |
| ***B21D 11/00*** | (2006.01) |
| ***B21D 11/22*** | (2006.01) |

(52) U.S. Cl.

CPC ..... *B21D 31/005* (2013.01)

(58) Field of Classification Search

CPC ..... B21D 31/005; B21D 31/00; B21D 22/14; B21D 22/18; B21D 22/185; B21D 35/008; B21C 23/004; B21J 5/006

See application file for complete search history.

(56) References Cited

U.S. PATENT DOCUMENTS

| | | | |
|---|---|---|---|
| 3,292,413 | A | 12/1966 | Falcioni |
| 4,646,595 | A | 3/1987 | Slee |

(Continued)

FOREIGN PATENT DOCUMENTS

| | | | |
|---|---|---|---|
| CN | 201744547 | U | 2/2011 |
| CN | 102343386 | A | 2/2012 |

(Continued)

OTHER PUBLICATIONS

English translate (CN103817176A), retrieved date Jul. 11, 2021.*

(Continued)

*Primary Examiner* — Jessica Cahill
*Assistant Examiner* — Mohammed S. Alawadi
(74) *Attorney, Agent, or Firm* — Vincent Mastrogiacomo; Brooks Kushman P.C.

(57) ABSTRACT

Systems and methods for forming a workpiece are disclosed. The system may include a fixture assembly for receiving a workpiece having opposing first and second surfaces, first and second tools, and a vibration source configured to vibrate the first and/or second tool. The first and second tools may be configured to move along first and second predetermined paths of motion as the first and/or second tool is vibrated by the vibration source and may exert force on the first and second surfaces to form the workpiece. The method may include vibrating a tool using a vibration source and moving the vibrating tool and another tool along first and second forming paths to form the workpiece. The vibration source may be an ultrasonic transducer and may vibrate the tool at a frequency of at least 1 kHz.

20 Claims, 5 Drawing Sheets

(56) References Cited

U.S. PATENT DOCUMENTS

| | | | | |
|---|---|---|---|---|
| 6,216,508 | B1 | 4/2001 | Matsubara et al. | |
| 6,338,765 | B1 | 1/2002 | Statnikov | |
| 6,517,319 | B2 * | 2/2003 | Webster | C21D 7/04 416/241 R |
| 7,508,116 | B2 * | 3/2009 | Liu | B23B 29/125 310/317 |
| 8,033,151 | B2 | 10/2011 | Castle et al. | |
| 8,302,442 | B2 | 11/2012 | Kiridena et al. | |
| 8,322,176 | B2 | 12/2012 | Johnson et al. | |
| 8,733,143 | B2 | 5/2014 | Kiridena et al. | |
| 8,776,564 | B2 | 7/2014 | Shimanuki et al. | |
| 8,783,078 | B2 | 7/2014 | Ren et al. | |
| 9,937,548 | B2 * | 4/2018 | Clarke | B21J 15/025 |
| 10,105,815 | B2 * | 10/2018 | Guo | B23P 9/04 |
| 10,414,009 | B2 * | 9/2019 | Kitakaze | B23Q 5/22 |
| 2007/0234772 | A1 | 10/2007 | Prevey, III | |
| 2009/0158805 | A1 * | 6/2009 | Callebaut | B21D 31/005 72/342.5 |
| 2010/0095724 | A1 | 4/2010 | Kotagiri et al. | |
| 2010/0257910 | A1 | 10/2010 | Castle et al. | |

FOREIGN PATENT DOCUMENTS

| | | | | |
|---|---|---|---|---|
| CN | 103817176 | A * | 5/2014 | B21D 31/005 |
| CN | 103817176 | A | 5/2014 | |
| EP | 1762305 | A2 * | 3/2007 | B23D 5/00 |
| JP | H01122624 | A | 5/1989 | |
| JP | H06297069 | A | 10/1994 | |

OTHER PUBLICATIONS

Translation by Google of JP H01122624 A by Espacenet.
Translation by Google of JP H06297069 A by Espacenet.
First Office Action for Chinese Application No. 201610608173.0, dated Dec. 11, 2018, 7 Pages.
2nd Office Action for Chinese Application No. 201606081730, dated Jul. 19, 2019 together with English Translation.

* cited by examiner

VIBRATION ASSISTED FREE FORM FABRICATION

CROSS-REFERENCE TO RELATED APPLICATIONS

This application is a division of U.S. application Ser. No. 14/810,609 filed Jul. 28, 2015, now U.S. Pat. No. 10,195,655, issued Feb. 5, 2019, the disclosure of which is incorporated in its entirety by reference herein.

TECHNICAL FIELD

The present disclosure relates to vibration-assisted free form fabrication, for example, of metal sheet.

BACKGROUND

Sheet metal forming is generally performed using a stamping process in which opposing tools having a desired geometry press the sheet metal into a desired shape. Stamping may be a very efficient and cost-effective process for high volume manufacturing. However, for low volume manufacturing or prototyping, the cost and energy required to produce stamping tools for each component design iteration may be prohibitively high. A sheet metal forming process that can produce cost-efficient prototypes in a timely manner would be highly beneficial.

SUMMARY

In at least one embodiment, a system for forming a workpiece is provided. The system may include a fixture assembly for receiving a workpiece having opposing first and second surfaces, first and second tools, and a vibration source configured to vibrate the first tool. The first and second tools may be configured to move along first and second predetermined paths of motion as the first tool is vibrated by the vibration source and to exert force on the first and second surfaces to form the workpiece.

In one embodiment, the first and second tools are configured to move along the first and second predetermined paths and to exert force on the first and second surfaces to form the workpiece without penetrating the first and second surfaces. The vibration source may be configured to vibrate the first tool at a frequency of 5 to 70 kHz. The vibration source may be configured to vibrate the first tool at an amplitude of 1 to 50 μm.

In one embodiment, the vibration source may be configured to vibrate the first tool in a direction substantially parallel to the first surface. In another embodiment, the vibration source may be configured to vibrate the first tool in a direction substantially perpendicular to the first surface. The system may include a manipulator including a tool holder configured to hold the first tool, wherein the vibration source includes a transducer that is attached to or integral with the tool holder.

The first and second predetermined paths may be complimentary such that pressure is applied to the first and second surfaces in a local area of the workpiece. In one embodiment, the vibration source is a first vibration source and the system further comprises a second vibration source configured to vibrate the second tool. The first and second vibration sources may be configured to vibrate the first and second tools at the same frequency.

In at least one embodiment, a system is provided including a fixture for holding a workpiece, a first tool, and a vibration source configured to vibrate the first tool. The first tool may be configured to move along a first surface of the workpiece and to exert a force on the workpiece against a second tool as the first tool is vibrated to form the workpiece.

The system may also include a first manipulator configured to move the first tool along multiple axes along the first surface of the workpiece and a second manipulator configured to move the second tool along multiple axes along a second surface of the workpiece. The second tool may include a mold having a surface contour. The vibration source may be configured to vibrate the first tool at a frequency of 5 to 70 kHz and at an amplitude of 1 to 50 μm. The system may include a manipulator including a tool holder configured to hold the first tool, wherein the vibration source includes a transducer that is attached to or integral with the tool holder.

In at least one embodiment, a method of forming a workpiece including opposing first and second surfaces is provided. The method may include positioning first and second tools, vibrating the first tool using a vibration source, and moving the vibrating first tool and the second tool along first and second forming paths along multiple axes such that the first and second tools contact the first and second surfaces to form the workpiece.

The first tool may be held by a tool holder and may be vibrated by a transducer attached to or integral with the tool holder. The first tool may be vibrated at a frequency of at least 1 kHz. The first and second forming paths may be complimentary and pressure may be applied to the first and second surfaces in a local area of the workpiece. The method may include vibrating the first tool at a frequency of 5 to 70 kHz to heat a local area of the workpiece to a temperature of 20 to 70% of a melting temperature of the workpiece.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
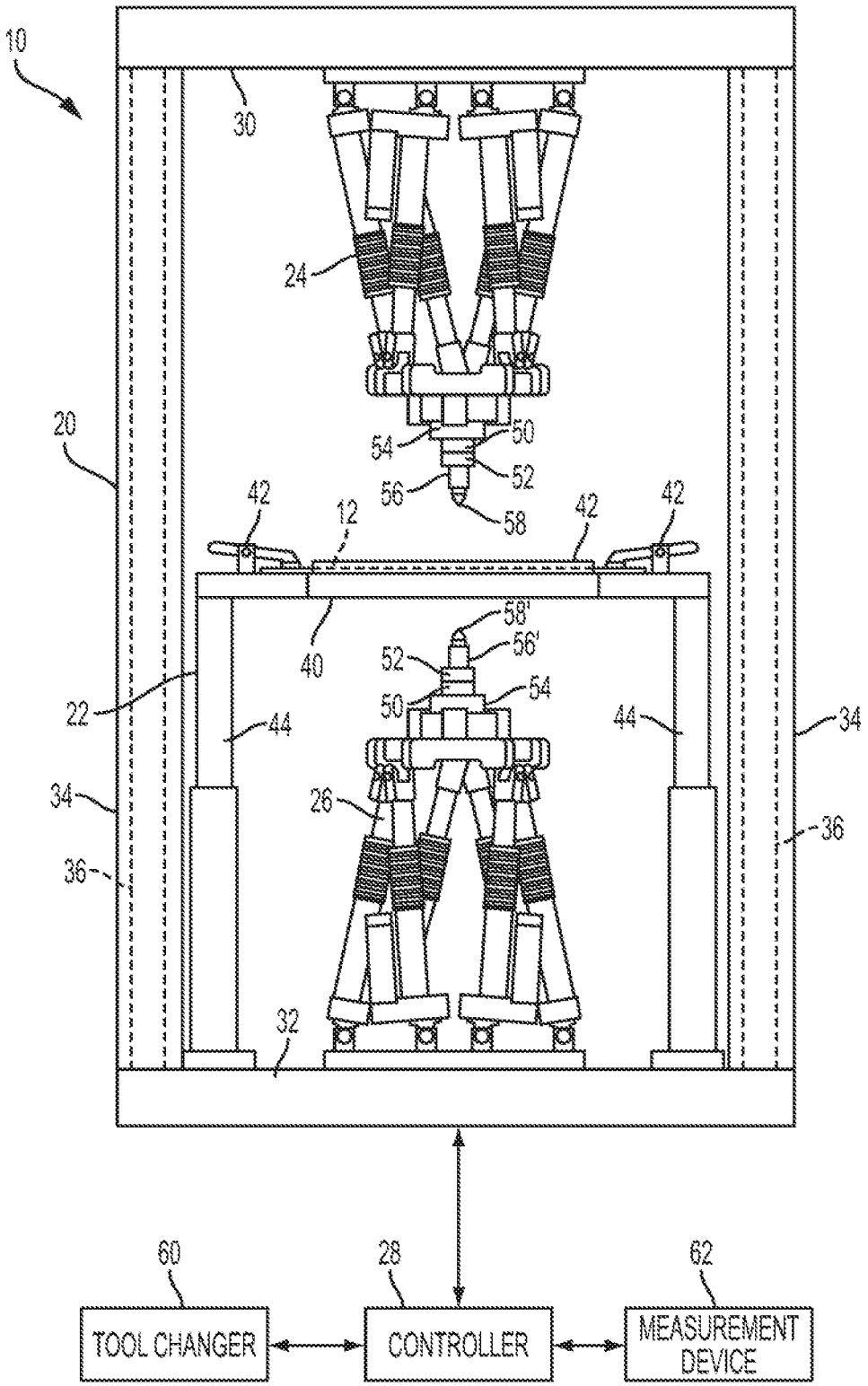
FIG. 1 is a side view of a system for incrementally forming a workpiece, according to an embodiment.

The Applicant has disclosed several systems and methods for incrementally forming a workpiece in U.S. Pat. Nos. 8,302,442; 8,322,176; and 8,733,143, the disclosures of which are hereby incorporated in their entirety by reference herein. The disclosed systems and methods may allow for the forming of sheet metal in low volumes that is both cost and time efficient. Referring to FIG. 1, an example of a system 10 for incrementally forming a workpiece 12 is shown. The system 10 may also be referred to as a free form fabrication system. The workpiece 12 may be made of any suitable material or materials that have desirable forming characteristics, such as a metal, metal alloy, polymeric material, or combinations thereof. In at least one embodiment, the workpiece 12 may be provided as sheet metal. The workpiece 12 may be generally planar or may be at least partially preformed or non-planar in one or more embodiments of the disclosed system 10.

The system 10 may include a support structure 20, a fixture assembly 22, a first manipulator 24, a second manipulator 26, and a controller 28. The support structure 20 may be provided to support various system components. The support structure 20 may have any suitable configuration. In the embodiment shown in FIG. 1, the support structure 20 has a generally box-like shape. Of course, the present disclosure contemplates that the support structure 20 may be provided in different configurations having a greater or lesser number of sides. In at least one embodiment, the support structure 20 may be configured as a frame that has first and second platforms 30, 32 that may be disposed opposite each other.

A set of support posts 34 may extend between the first and second platforms 30, 32. The support posts 34 may be provided as solid or hollow tubular members in one or more embodiments. One or more tensile members 36 may be provided to exert force on the support structure 20 to provide a desired amount of stability and rigidity. In at least one embodiment, the tensile members 36 may be provided inside the support posts 34 and may exert a tensile force that biases the first and second platforms 30, 32 toward each other. The tensile members 36 may be of any suitable type, such as compressive cylinders, springs, pretensioned rods, or the like. In at least one embodiment, the force exerted by the tensile members 36 may be adjustable to provide different performance characteristics.

A plurality of openings may be provided between the platforms 30, 32 and support posts 34 that may facilitate access to system components and the installation and removal of the workpiece 12. One or more openings may be at least partially covered with a cover material, such as metal or plexiglass, that helps define an envelope in which workpiece forming occurs. Various safety features may be associated with openings or cover materials to enable or disable system operation in a manner known by those skilled in the art.

The fixture assembly 22 may be provided to support the workpiece 12. The fixture assembly 22 may include a frame that at least partially defines an opening 40. The opening 40 may be at least partially covered by the workpiece 12 when a workpiece 12 is received by the fixture assembly 22. A plurality of clamps 42 may be provided with the fixture assembly 22 to engage and exert force on the workpiece 12. The clamps 42 may be provided along multiple sides of the opening 40 and may have any suitable configuration. For instance, the clamps 42 may be manually, pneumatically, hydraulically, or electrically actuated. Moreover, the clamps 42 may be configured to provide a fixed or adjustable amount of force upon the workpiece 12. For example, one or more clamps 42 may be configured to provide a constant amount of force to hold the workpiece 12 in a fixed position. Alternatively, one or more clamps 42 may be configured to provide an adjustable amount of force to permit a desired amount of material draw with respect to the opening 40.

The fixture assembly 22 may be configured to move with respect to the support structure 20. For example, the fixture assembly 22 may be configured to move toward or away from the first platform 30, the second platform 32, and/or the support posts 34. In FIG. 1, the fixture assembly 22 may move along a vertical or Z axis. In at least one embodiment, the fixture assembly 22 may be mounted on one or more support members 44 that may be configured to extend, retract, and/or rotate to move the fixture assembly 22 and a workpiece 12 with respect to at least one forming tool to help provide an additional range of motion and enhance formability of the workpiece 12. The fixture assembly 22 may move such that it remains parallel to the first or second platforms 30, 32 or such that the fixture assembly 22 tilts to achieve a non-parallel relationship. Movement of fixture assembly 22 may occur when the workpiece 12 is being formed.

The first and second positioning devices or manipulators 24, 26 may be provided to position forming tools. The first and second manipulators 24, 26 may be mounted on the first and second platforms 30, 32, respectively. Alternatively, the first and second manipulators 24, 26 may be directly mounted on the support structure 22 in one or more embodiments of the present disclosure. The first and second manipulators 24, 26 may have the same or different configurations. For instance, the first and second manipulators 24, 26 may have multiple degrees of freedom, such as hexapod manipulators that may have at least six degrees of freedom, like a Fanuc Robotics model F-200i hexapod robot. Such manipulators may generally have a plurality of prismatic links or struts that joint a base to a platform. The links or struts may be linear actuators, such as hydraulic cylinders that can be actuated to move the platform with respect to the base. A manipulator with six degrees of freedom may move in three linear directions and three angular directions singularly or in any combination. For example, the manipulators may be configured to move an associated tool along a plurality of axes, such as axes extending in different orthogonal directions like X, Y and Z axes.

The first and second manipulators 24, 26 may receive a plurality of components that facilitate forming of the workpiece 12. These components may include a load cell 50, a heating element 52, a spindle 54, a tool holder 56, 56', and a forming tool 58, 58'. One or more load cells 50 may be provided to detect force exerted on the workpiece 12. Data provided by the load cell 50 may be communicated to the controller 28 and may be used to monitor and control operation of the system 10 as will be described below in more detail. The load cell 50 may be disposed in any suitable location that supports accurate data collection, such as proximate the heating element 52, spindle 54, tool holder 56, 56', or forming tool 58, 58'.

The heating element 52 may be of any suitable type and may be electrical or non-electrically based. The heating element 52 may provide energy that may be transmitted to the workpiece 12 to help provide desired forming and/or surface finish attributes. The heating element 52 may directly or indirectly heat the workpiece 12. For example, the heating element 52 may be provided in or near the forming tool 58, 58' to directly or indirectly heat the forming tool 58, 58' which in turn heats the workpiece 12. In at least one other embodiment, a laser or heating element may directly heat at least a portion of the workpiece 12. Alternatively, one or more heating elements 52 may be disposed on another system component, such as the fixture assembly 22. Heating elements 52 associated with the first and second manipulators 24, 26 may operate simultaneously or independently. In at least one embodiment, operation of one heating element 52 may primarily heat one side of the workpiece 12 and may facilitate differences in stress reduction or surface finish characteristics between different sides or regions of the workpiece 12.

The spindle 54 may be provided to rotate a tool holder 56, 56' and an associated forming tool 58, 58' about an axis of rotation. If provided, the spindle 54 may be mounted on a manipulator 24, 26 and may provide additional material forming capabilities as compared to a forming tool that does not rotate. In addition, the spindle 54 may be actively or passively controlled. Active control may occur by programming or controlling rotation of the spindle 54, which may occur with or without synchronizing spindle motion with movement of a manipulator 24, 26. Passive control may occur by allowing the spindle 54 to freely rotate in response to force exerted against the workpiece 12, such as force transmitted via a forming tool to the spindle 54.

The tool holders 56, 56' may receive and hold a forming tool 58, 58'. The tool holders 56, 56' may have the same or different configurations. The tool holder 56, 56' may include an aperture that may receive a portion of the forming tool 58, 58'. Moreover, the tool holder 56, 56' may secure the forming tool 58, 58' in a fixed position with a clamp, set screw, interference fit, or other mechanism as is known by those skilled in the art. The tool holder 56, 56' and/or forming tool 58, 58' may also be associated with an automated tool changer 60 that may facilitate rapid interchange or replacement of tools as is also known by those skilled in the art.

The forming tool 58, 58' may impart force to form the workpiece 12. The forming tool 58, 58' may have any suitable geometry, including, but not limited to flat, curved, spherical, or conical shape or combinations thereof. In addition, the forming tool 58, 58' may be configured with one or more moving features or surfaces, such as a roller. Forming tools with the same or different geometry may be provided with the first and second manipulators 24, 26. Selection of the forming tool geometry, hardness, and surface finish attributes (e.g., coatings or textures) may be based on compatibility with the workpiece material and the shape, finish, thickness, or other design attributes desired in the formed workpiece 12.

The one or more controllers 28 or control modules may be provided for controlling operation of the system 10. For example, the controller 28 may monitor and control operation of the fixture assembly 22, manipulators 24, 26, load cell 50, heating element 52, spindle 54, and tool changer 60. The controller 28 may be adapted to receive CAD data and provide computer numerical control (CNC) to form the workpiece 12 to design specifications. In addition, the controller 28 may monitor and control operation of a measurement system 62 that may be provided to monitor dimensional characteristics of the workpiece 12 during the forming process. The measurement system 62 may be of any suitable type. For example, measurements may be based on physical contact with the workpiece 12 or may be made without physical contact, such as with a laser or optical measurement system.

As previously stated, the system 10 may be used to incrementally form a workpiece. In incremental forming, a workpiece is formed into a desired configuration by a series of small incremental deformations. The small incremental deformations may be provided by moving one or more tools along or against one or more workpiece surfaces. Tool movement may occur along a predetermined or programmed path. In addition, a tool movement path can also be adaptively programmed in real-time based on measured feedback, such as from the load cell. Thus, forming may occur in increments as at least one tool is moved and without removing material from the workpiece.

In one embodiment, the material to be incrementally formed may be loaded into the system. The material, which may be at least partially preformed, may be manually or automatically positioned and aligned in the fixture assembly 22 over at least a portion of the opening 40. The workpiece may then be clamped to secure the material in a desired location as previously discussed. In addition, a friction reducing material like wax or a lubricant may be provided on one or more surfaces of the material to be formed to help reduce friction and/or improve finish.

The material may then be "rough formed" or generally formed to an intermediate shape. Rough forming may cause the shape of the material to change such that at least a portion of the workpiece is not formed into a final or target shape. Rough forming may be accomplished by operation of the first and second manipulators 24, 26. For instance, the controller 28 may execute a program to move the manipulators 24, 26 such that their respective tools contact and exert force on the material to change its shape. One or more tools may be used to rough form the material. Use of one tool may result in reduced local deformation control of the workpiece as compared to the use of more than one tool. Use of multiple tools may result in improved dimensional accuracy since forces exerted on one side of the workpiece may be at least partially offset or affected by force exerted by a tool on an opposite side of the workpiece. As such, one tool may provide localized support that reduces localized movement of the material.

Figure 2:
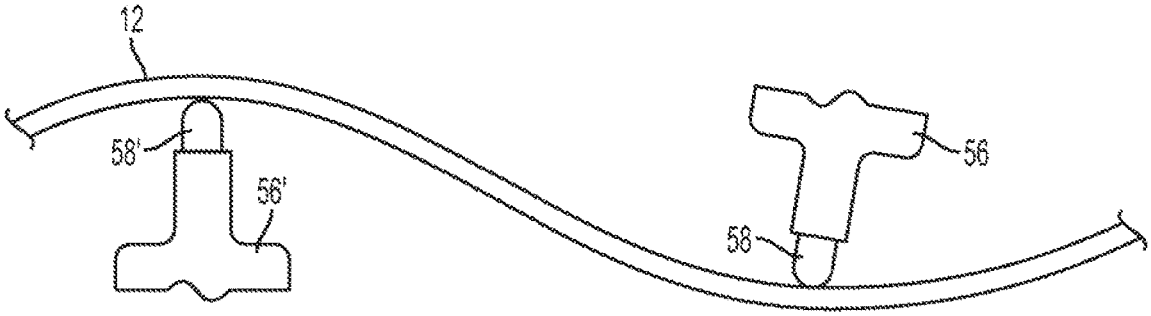
FIG. 2 is a schematic side view of a workpiece being formed by the system of FIG. 1, according to an embodiment.

During rough forming, the manipulators may position or move the tools such that they are not in close opposite proximity (i.e., not in close proximity or alignment while being located on opposite or different sides of the workpiece) as is illustrated in FIG. 2. In FIG. 2, the first and second tools 58, 58' are shown exerting force on the workpiece 12 such that a curved surface results. During rough forming, the first and second tools may be moved along the same or different paths and such movement may or may not be synchronized with each other.

Figure 3:
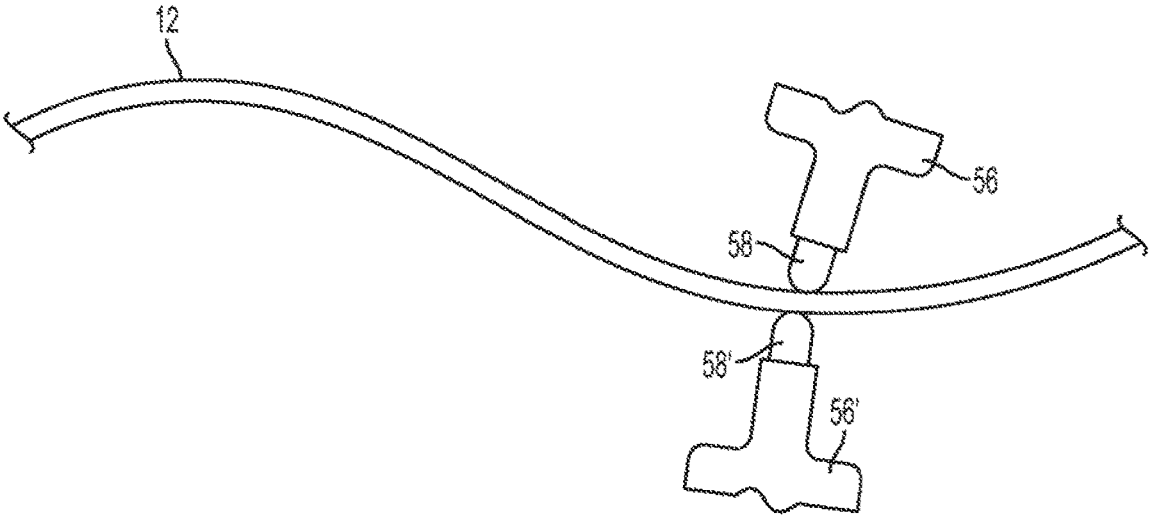
FIG. 3 is a schematic side view of a workpiece being formed by the system of FIG. 1, according to another embodiment.

The material may then be "finish formed" such that the final desired shape of the workpiece is attained. Finish forming may compensate for deviations from design intent that may be due to metal relaxation and overall deformation of the workpiece due to rough forming and/or tool positioning or a tool contact position that differs from design intent. Finish forming may occur by actuating the manipulators such that multiple tools are positioned in close opposite proximity with each other (i.e., in close proximity or alignment while being located on opposite or different sides of the workpiece). An exemplary depiction of finish forming is shown in FIG. 3. During finish forming, the deviation from a desired or target shape may be adjusted or corrected by exerting force on different sides of the workpiece such that the force exerted by one tool is at least partially offset or counteracted by the force exerted by another tool. More specifically, the tools may be positioned in sufficiently close proximity to help more precisely control forming of the workpiece. The manipulators may generally move the tools along similar paths to similar locations during finish forming such that sufficient close proximity is attained and/or maintained.

After the finish forming step, the dimensions of the formed workpiece may be assessed. Dimensional assessment may be accomplished using a measurement system as previously discussed. If one or more dimensional characteristics are not within a predetermined tolerance then additional forming operations may be executed and/or programming adjustments may be made. The finished workpiece may then be removed from the system. More specifically, the clamps may be released and disengaged from the workpiece such that the material can be removed from the fixture assembly.

Free form fabrication of sheet metal relies on localized plastic deformation of the material in contact between two stylus-type forming tools. Controlled clamp pressure and displacement of the two contacting stylus-type tips may gradually draw the material into shape by repeated forming passes offset from each other. It has been found that plastic deformation of the material may result in grain structure alteration and/or thinning of the formed material. For example, the grains of the formed material may elongate and harden the material, similar to a rolling process. These physical material changes may limit the forming capability of the process. The previously described process forming tool geometries and forces required to draw the material generally do not lend themselves to thin metal foil forming (e.g., less than 1 mm thick). In addition, it would be beneficial to improve the free forming of sheet metal that is at least 1 mm thick, for example, increasing the distance the sheet may be drawn during a forming operation or mitigating the change in the grain structure or properties of the material.

It has been realized that applying high-frequency vibration, for example ultrasonic vibration, may improve the performance and/or increase the sheet thickness range of the free form fabrication system 10. Without being held to any particular theory, it is believed that by applying vibration to the forming tools/tips, the material in contact between the tools/tips is subsequently excited and heated, and thereby softened. The softening of the material may, as a result, improve the plastic deformation limits for the forming process. Vibration of the stylus tip(s) in conjunction with controlled clamp pressure may excite/heat/soften the material directly in contact between the tips. The effect on the material may be extremely fast and localized, such that surrounding areas of the material are not significantly affected. The plastic deformation forming limits of the locally softened material between the tips may be improved, thus allowing the material to flow and/or form more freely. Excitation of the material may allow for less deformation pressure to be required to draw, form, and/or shape the material, thereby allowing the free form fabrication process to be used with thinner materials (e.g., thin foil materials), compared to previous systems. Free form fabrication of thicker materials may also benefit from vibration-assisted stylus-tips by allowing the thicker materials to be drawn and/or formed to greater extents. Excitation and subsequent deformation of the materials may minimize the alteration of the formed material properties. Accordingly, excitation of free forming fabrication tips may enable the use of the free forming fabrication process with thin metal foils and/or improve the free forming fabrication limits of thick (e.g., ≥1 mm) foils.

Vibration or excitation may be applied to free form fabrication systems in a plurality of ways. In at least one embodiment, a vibration source 64 may be attached, connected to, or coupled to one or both of the tools 58 and 58'. In one embodiment, the vibration source 64 may include a vibration transducer, such as an ultrasonic transducer, that converts another type of energy into vibrational energy. The transducer may be any suitable type of transducer, such as a contact transducer. Transducers, such as ultrasonic transducers, may include piezoelectric transducers or capacitive transducers, which convert electrical energy into acoustic vibrations. Piezoelectric transducers may include piezoelectric crystals that change size when a voltage is applied. Therefore, applying an alternating current (AC) across the crystals causes them to oscillate at very high frequencies, producing high frequency acoustic vibrations (e.g., ultrasonic vibrations). Capacitive transducers work based on a similar principle, except that the transduction is due to changes in capacitance. These are merely examples, however, and any other suitable method of producing vibration may be used. For example, magnetostrictive materials may be used, which change size by a small amount when exposed to a magnetic field.

Figure 4:
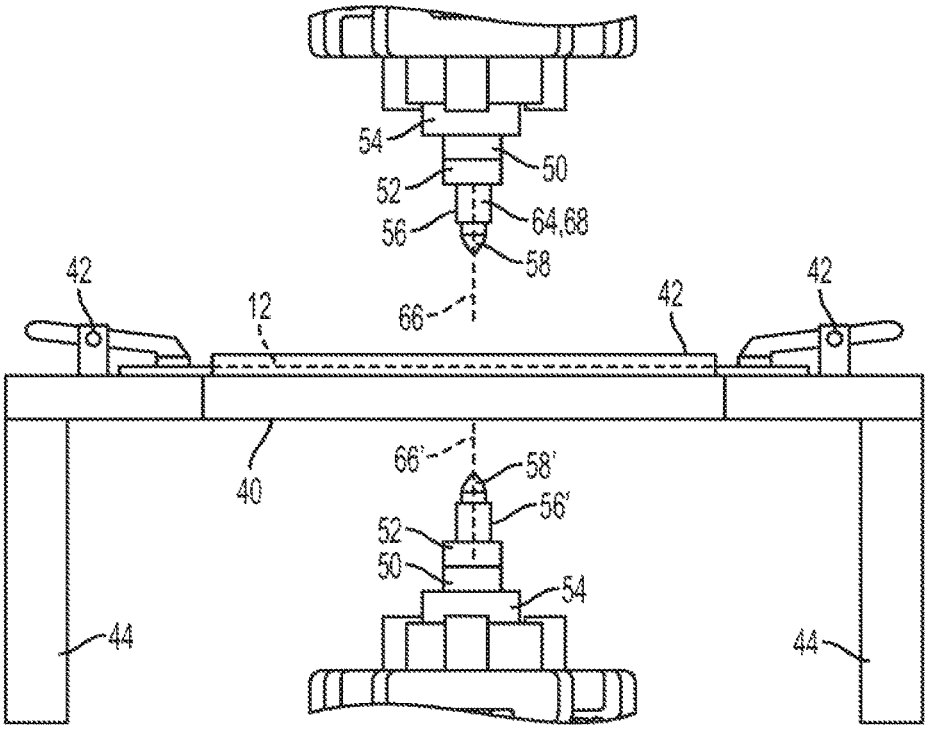
FIG. 4 is a side view of a system for incrementally forming a workpiece including a source of vibration, according to an embodiment.
Figure 5:
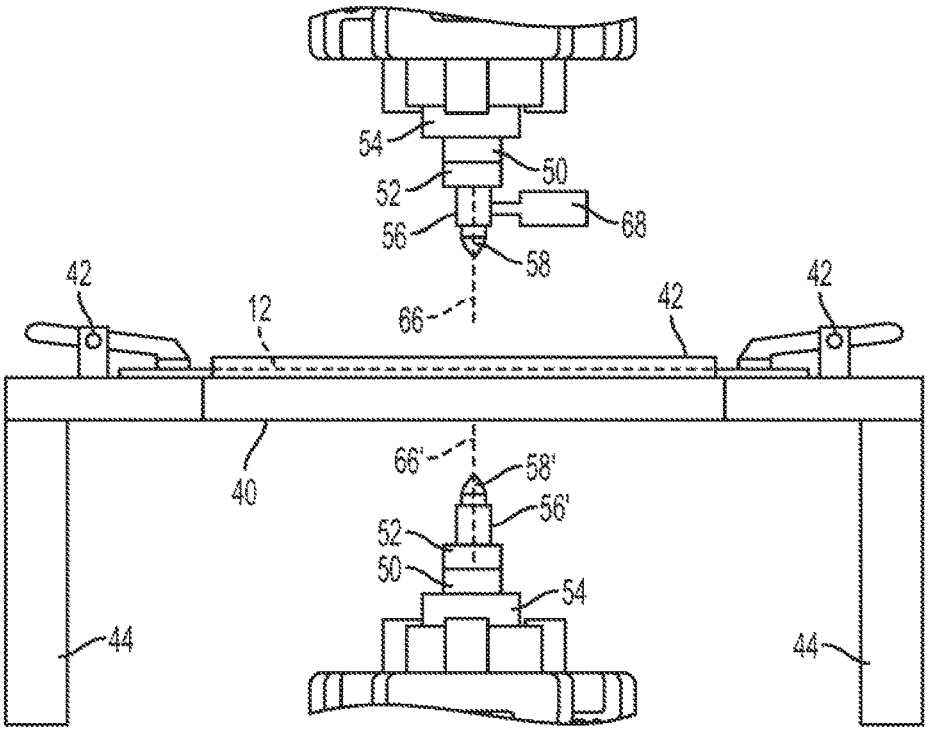
FIG. 5 is a side view of a system for incrementally forming a workpiece including a source of vibration, according to another embodiment.

The vibration source 64 may be located in any suitable location such allows vibration to be transmitted to the tool 58 and/or 58'. The vibration source 64 may be attached to or be integral with the tool holder 56, the heating element 52, the load cell 50, the spindle 54, or may be located between any two of the above. The placement of the vibration source 64 may be chosen to allow for tuning of the vibration source with the acoustic nature of the system. Tuning is generally done in one-half wave length intervals of the resonant frequency of the acoustic system. Alternatively, the vibration source 64 may be attached to or be integral with the tool 58 and/or 58'. In these embodiments, the tool 58 and/or 58' may have a geometry allowing for proper vibration wave propagation. In one embodiment, the vibration source 64 is attached to or integral with the tool holder 56. In an embodiment shown in FIG. 4, the vibration source 64 is attached to or integral with the tool holder 56 and the vibration source 64 is configured to produce vibrations in a direction parallel to the long axis 66 of the tool holder and perpendicular to the surface of the workpiece 12 being formed. The vibration source may include a transducer 68 that is integrally formed with or attached to the tool holder 56. In an embodiment shown in FIG. 5, the vibration source 64, which may be a transducer 68, that is attached to or integral with the tool holder 56 and configured to produce vibrations in a direction perpendicular to the long axis 66 of the tool holder and parallel to the surface of the workpiece 12 being formed. While the vibration source 64 is shown attached to or integral with tool holder 56 to vibrate tool 58 in FIGS. 4 and 5, it may instead be attached to or integral with tool holder 56' to vibrate tool 58'. A vibration source 64 (e.g., a transducer 68) may also be attached to or integral with both tool holder 56 and 56' to vibrate both tools 58 and 58'. The vibration of the tool 58' may similarly be parallel or perpendicular to the long axis 66' of the tool holder 56'.

In at least one embodiment, the vibration source 64 is an ultrasonic transducer. The vibration source 64 may cause the tool 58 and/or 58' to vibrate. The vibration may be at a fixed frequency with a set frequency range (e.g., 20 kHz±500 Hz). The frequency range may also be set for a certain period of time and then be adjusted to a different frequency range for another period of time. The frequency may be adjusted based on the position of the tool(s) on the workpiece, changes in the material properties of the workpiece, heating of the acoustic system, or other factors. In one embodiment, the frequency may be at least 1 kHz, for example, at least 5, 10, 18, 20, 25, 50, 60, 100, or 150 kHz. Stated as ranges, the vibration source 64 may cause the tool 58 and/or 58' to vibrate at a frequency of 1 to 150 kHz, or any sub-range therein. For example, the tool(s) may vibrate at 1 to 100 kHz, 10 to 100 kHz, 10 to 90 kHz, 15 to 90 kHz, 20 to 90 kHz, 30 to 90 kHz, 40 to 80 kHz, 50 to 70 kHz, 55 to 70 kHz, 5 to 70 kHz, 5 to 40 kHz, 10 to 35 kHz, 10 to 30 kHz, 15 to 25 kHz, or other sub-ranges. Stated another way, the tool(s) may vibrate at about 20, 25, 30, 35, 40, 45, 50, 55, 60, 65, 70, 75, or 80 kHz, with "about" meaning ±5 kHz. The frequency may be chosen based on the application, and may be influenced by factors such as material type (e.g., metal or polymer), material properties (e.g., hardness, grain structure, etc.), the desired part geometry, or others. The frequency of the vibration source 64 may be controlled by a controller, which may adjust the frequency of the vibration source in order to maintain an ideal or nearly ideal resonant frequency for the entire acoustic system. Frequencies outside of the above ranges/values may also be used, however, lower frequencies may not be as effective and higher frequencies may offer diminishing returns or damage the material being formed.

Figure 6:
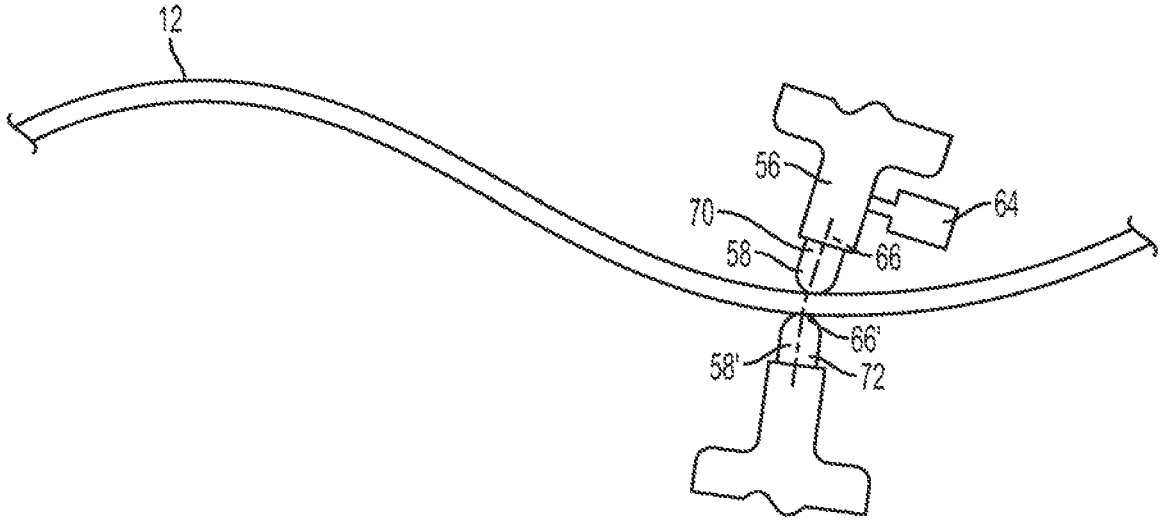
FIG. 6 is a schematic side view of a workpiece being formed by a system including a source of vibration, according to an embodiment.
Figure 7:
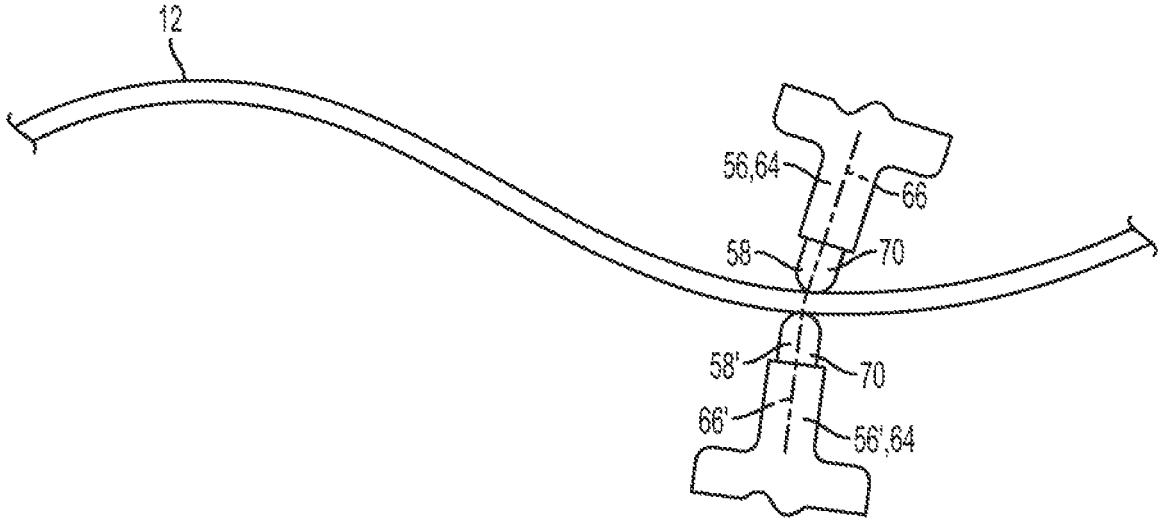
FIG. 7 is a schematic side view of a workpiece being formed by a system including a source of vibration, according to another embodiment.
Figure 8:
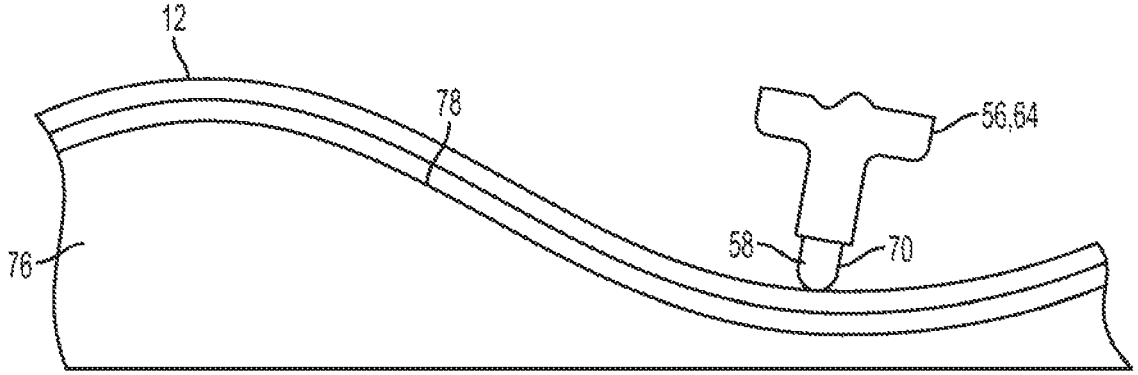
FIG. 8 is a schematic side view of a workpiece being formed by a system including a source of vibration and a mold, according to an embodiment.

With reference to FIGS. 6-8, schematic examples of the system 10 forming a workpiece 12 are shown. In at least one embodiment, shown in FIG. 6, only one of the tool 58 and tool 58' is coupled to a vibration source 64. For example, the tool 58 may be vibrated, while the tool 58' is not. In this example, the tool 58 may act as the horn 70 and the tool 58' may act as the anvil 72. The terms "horn" and "anvil" as used herein are analogous to the terms used in ultrasonic welding. The horn 70 is the component that applies the vibration to the component, which is the workpiece 12 in this embodiment. The anvil 72 is an opposing surface to the horn, which may allow for positioning and/or support of the workpiece 12. The anvil 72 may be disposed opposite the horn 70, with the workpiece 12 in between. The anvil 72 may be static (e.g., not vibrated). In ultrasonic welding, there is generally also a press to apply pressure to the two parts being joined so that the vibration can be focused on the spot to be fused. However, in the present disclosure, there is only one workpiece 12 that is being formed (not attached to another component) and the pressure may be provided by the force between the two tools 58, 58' from the manipulators 24, 26. As described above, the vibration source 64 may be configured to vibrate the tool 58 in a direction parallel or perpendicular to the long axis 66 of the tool holder 56. In the embodiment shown in FIG. 6, the vibration source 64 is configured to vibrate the tool 56 in a direction perpendicular to the long axis 66.

In another embodiment, shown in FIG. 7, both the tool 58 and the tool 58' may be coupled to a vibration source 64. In this embodiment, both the tool 58 and the tool 58' may act as a horn 70 independent of each other or as an anvil if no vibration is requested from the vibration source 64. In embodiments where both tools 58, 58' are vibrated, the vibration sources 64 may be configured to have the same frequency or different frequencies. Similarly, the amplitudes may be the same or different and they may be in-phase or out-of-phase. In one embodiment, the tools 58 and 58' may vibrate at the same frequency and amplitude. In another embodiment, they may also be vibrated out of phase. Providing vibration to both tools 58 and 58' may increase the amount of excitation or local heating in the workpiece 12. As a result, forming of the workpiece 12 may be easier and/or the drawing limits may be improved (e.g., deeper drawing or thinner workpieces). As described above, the vibration sources 64 may be configured to vibrate the tools 58 and 58' in a direction parallel or perpendicular to the long axes 66 and 66' of the tool holders 56 and 56'. In the embodiment shown in FIG. 7, the vibration sources 64 are configured to vibrate the tools 58 and 58' in a direction parallel to the long axes 66 and 66'.

Figure 9:
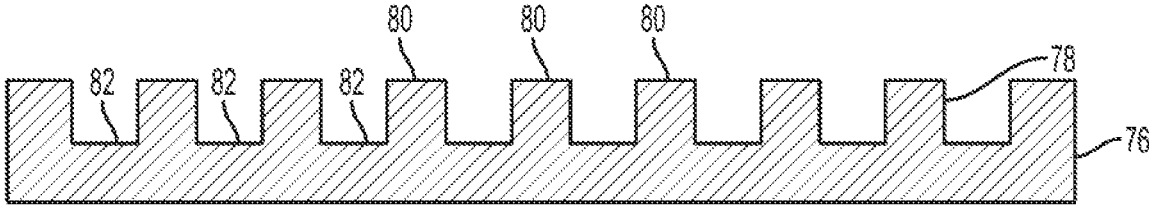
FIG. 9 is an example of a cross-section of a mold that may be used with a system for incrementally forming a workpiece including a source of vibration, according to an embodiment.

In another embodiment, shown in FIG. 8, one manipulator in the system 10 may be removed or not used, and may be replaced by a mold 76. For example, manipulator 26 may be removed or moved away from the workpiece 12. In its place, a mold 76 may be positioned on one side (e.g., under) of the workpiece 12. In another embodiment (not shown), the mold 76 may be mounted to the manipulator 26, replacing some or all of elements 50, 52, 54, 56 and 58. The mold 76 may have a surface contour 78 with an inverse shape to that of a desired component. The manipulator 24 may incrementally form the workpiece 12 onto the mold 76 using tool 58 by traveling on a predetermined or programmed path, similar to described above. If the mold 76 is mounted to the manipulator 26, the manipulator 24 may travel in unison with manipulator 26. In these embodiments, the tool 58 may be vibrated using a vibration source 64. Similar to the embodiment described with respect to FIG. 6, the tool 58 may act as a horn 70. However, in these embodiments the mold 76 may act as an anvil, providing an opposing surface, support, and/or positioning to the tool 58 to allow pressure to be exerted on the workpiece 12 between the tool 58 and mold 76. In one embodiment, an example cross-section of which is shown in FIG. 9, the mold 76 may have a surface contour 78 that is the inverse of a desired bi-polar plate geometry for a fuel cell. The mold 76 may have a plurality of peaks 80 and valleys 82 to form gas channels or other plate features in the resulting bi-polar plate.

As described above, the addition of the vibration source 64 to the system 10 may allow for thinner metal sheet to be formed using the free form fabrication system. In at least one embodiment, metal sheet having an initial thickness of up to 1 mm may be formed or shaped. For example, metal sheet having an initial thickness of less than or equal to 0.5, 0.4, 0.3, 0.2, 0.1, or 0.05 mm may be formed using the system 10 including a vibration source 64. In one embodiment, the metal sheet may have an initial thickness of 0.05 to 0.9 mm, or any sub-range therein, such as 0.05 to 0.75 mm, 0.05 to 0.5 mm, 0.05 to 0.25 mm, 0.05 to 0.15 mm, 0.05 to 0.1 mm, or about 0.1 mm.

In addition to allowing thinner metal sheet to be formed or shaped by the free form fabrication system 10, the vibration of the tool(s) 58, 58' may also allow increased drawing of thicker metal sheet (e.g., ≥1 mm). This may be due to softening of the material during drawing. The degree or limit of drawing may vary based on factors such as material type, material properties, and geometry. The vibration of the tool(s) 58, 58' may allow increased drawing of a metal sheet compared to the same metal sheet being drawn under the same conditions but without vibration. For example, certain metal sheets currently have a draw limit of about 150%. However, with vibration of the tool(s), the draw limit may be 175%, 200%, or higher.

The amplitude of the vibration produced by the vibration source 64 in the tool 58 and/or 58' may be set depending on the metal being formed, the shape to be formed, or other factors. In general, a higher amplitude will provide increased excitement and/or heating to the workpiece 12. In at least one embodiment, the amplitude of the vibration may be from 0.5 to 100 μm, or any sub-range therein. For example, the amplitude may be from 0.5 to 75 μm, 1 to 50 μm, 5 to 50 μm, 5 to 45 μm, 10 to 45 μm, 15 to 45 μm, 15 to 40 μm, or 20 to 35 μm. As described above, the amplitude may describe movement in the vertical direction (e.g., perpendicular to the workpiece) or in the horizontal direction (e.g., parallel to the workpiece). As is known in the art of ultrasonic welding, various sized boosters may be added to the vibration source 64 and included in the system 10, such as in the tool(s) or tool holder(s). The boosters may modify (e.g., increase) the amplitude of the vibration from the vibration source 64.

The system 10 including a tool coupled to a vibration source 64 may be used to form or shape any metal sheet. Non-limiting examples of metals that may be formed by the system 10 include steel, aluminum, titanium, or alloys thereof. The parameters of the vibration source, such as frequency and amplitude, transducer orientation, force applied to the workpiece, tip material, or others will generally be adjusted based on the material being formed. For example, the parameters may be adjusted based on the physical properties and/or characteristics of the workpiece (e.g., thickness, hardness or grain size).

As described above, the vibration of the tool(s) may cause localized heating of the metal workpiece, thereby making it easier to form and shape. The local temperature of the workpiece (e.g., region between the tools 58 and 58' or a tool 58 and mold 76) may be raised to a temperature below the melting point of the workpiece metal. In one embodiment, the local temperature of an alloy may be increased to 90 to 200° F., or any sub-range therein, by the vibration. For example, the local temperature may be increased to 90 to 150° F., 90 to 130° F., 100 to 130° F., 105 to 125° F., 110 to 125° F., 105 to 120° F., 110 to 120° F., or other sub-ranges. The local temperature of an alloy may also be increased to a percentage of the alloy melting temperature. For example, the alloy may be heated to 10 to 80% of its melting temperature, or any sub-range therein, such as 20 to 70%, 25 to 65%, 30 to 60%, 35 to 55%, or 40 to 50% of its melting temperature.

The vibration source(s) 64 may be controlled by the one or more controllers 28 (or a separate controller) in a manner similar to that described above for the manipulators, load cells, and other components. For example, the controller(s) 28 may monitor and control operation of the vibration source(s) 64, such as transducers 68. The controller(s) 28 may control the frequency of vibration of the tool(s), the amplitude of the vibration, the timing of the vibration, or other parameters. The controller 28 may control the parameters of vibration source(s) in response to the resonant characteristic of the system. In addition, the controller(s) 28 may monitor and control operation of the measurement system 62 that may be provided to monitor dimensional characteristics of the workpiece 12 during the forming process, which may include the local temperature of the workpiece 12 and/or the frequency and/or amplitude of the vibration of the workpiece 12.

The disclosed systems and methods may be employed to form a workpiece with complex geometries without incurring the costs and lead time associated with the design, construction, and transportation of dies that have historically been employed to form workpieces like sheet metal. Moreover, capital investment in associated equipment (e.g., presses) may be reduced or avoided. As such, the cost per piece and time to production may be substantially reduced. Moreover, the disclosed systems and methods may produce a part with improved surface quality and dimensional accuracy as compared to other techniques, such as single point incremental forming. Additionally, energy consumption may be reduced. Such advantages may be realized in prototyping, small volume production, and/or higher volume production operations.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A method of forming a workpiece including opposing first and second surfaces, comprising:

positioning first and second tools;

moving the first tool and the second tool along first and second forming paths along multiple axes such that the first and second tools contact the first and second surfaces to form the workpiece, the first and second forming paths being different and not synchronized; and concurrently vibrating the first tool in a first direction using a vibration source and vibrating the second tool in a second direction using a second vibration source without penetrating the first or second surfaces while moving the first and second tool along the different first and second forming paths.

2. The method of claim 1, wherein the first tool is held by a tool holder and is vibrated by a transducer attached to or integral with the tool holder.

3. The method of claim 1, wherein the first tool is vibrated at a frequency of at least 1 kHz.

4. The method of claim 1, wherein the first and second forming paths are complimentary and pressure is applied to the first and second surfaces in a local area of the workpiece.

5. The method of claim 1 further comprising vibrating the first tool at a frequency of 5 to 70 kHz to heat a local area of the workpiece to a temperature of 20 to 70% of a melting temperature of the workpiece.

6. The method of claim 1 wherein the second direction is perpendicular to the second surface.

7. The method of claim 1, wherein an intermediate shape is formed during rough forming and a final shape is formed during finish forming.

8. The method of claim 7, wherein the rough forming includes the first and second tools are not in alignment with the first and second forming paths being different and/or not synchronized and finish forming includes the first and second tools in alignment with the first and second forming paths being similar.

9. The method of claim 1, further comprising the assessing the workpiece and performing additional forming operations and/or programming adjustments.

10. The method of claim 1, wherein the first tool is positioned with a first manipulator and the second tool is positioned with a second manipulator and each of the first and second manipulators has at least six degrees of freedom.

11. The method of claim 10, wherein the first and second manipulators are hexapod manipulators.

12. The method of claim 1, wherein the first and second tools have different geometries.

13. The method of claim 1, wherein the first direction is parallel to the first surface.

14. The method of claim 13 further comprising vibrating the second tool in a second direction that is different than the first direction.

15. The method of claim 1, wherein the first direction is perpendicular to the first surface.

16. The method of claim 15 further comprising vibrating the second tool in a second direction that is the same as the first direction.

17. The method of claim 15 further comprising vibrating the second tool in a second direction that is perpendicular to the second surface.

18. The method of claim 1, further comprising a step of monitoring and operating, via a controller, a measurement system for local temperature and controlling the vibration sources.

19. A method of forming a workpiece comprising:

moving first and second tools along different first and second predetermined paths to exert force on first and second opposing surfaces of the workpiece to form the workpiece without penetrating the first and second surfaces; and with first and second vibration sources, concurrently vibrating first and second tools according to different first and second vibration parameters as the first and second tools move on the workpiece along the different first and second predetermined paths, wherein the first vibration source is configured to vibrate the first tool in a direction parallel to the first surface.

20. A method comprising:

without penetrating opposing first and second surfaces of a workpiece, moving opposing first and second tools along predetermined paths to exert force on the first and second surfaces; and during the moving, concurrently vibrating the first tool in a direction perpendicular to the first surface at a first frequency, and the second tool in a direction parallel to the second surface at a second frequency different than the first frequency.

* * * * *